US006821238B2

(12) United States Patent
Crevier et al.

(10) Patent No.: US 6,821,238 B2
(45) Date of Patent: Nov. 23, 2004

(54) METHOD OF PREPARING ZIPPER FOR USE IN RECLOSABLE GUSSET BAGS

(75) Inventors: Donald L. Crevier, Essex, IL (US); Steven Ausnit, New York, NY (US); Michael McMahon, Palatine, IL (US); Duane Piechocki, Pleasantville, NY (US)

(73) Assignee: Illinois Tool Works Inc., Glenview, IL (US)

( * ) Notice: Subject to any disclaimer, the term of this patent is extended or adjusted under 35 U.S.C. 154(b) by 290 days.

(21) Appl. No.: 09/725,991

(22) Filed: Nov. 29, 2000

(65) Prior Publication Data

US 2002/0065185 A1 May 30, 2002

(51) Int. Cl.[7] ..... B31B 1/90
(52) U.S. Cl. ..... 493/213; 493/927
(58) Field of Search ..... 493/212, 213, 493/214, 927; 53/412, 133.4, 139.2; 156/66

(56) References Cited

U.S. PATENT DOCUMENTS

| | | | | | |
|---|---|---|---|---|---|
| 4,094,729 | A | * | 6/1978 | Boccia | 156/515 |
| 5,067,822 | A | * | 11/1991 | Wirth et al. | 156/66 |
| 6,110,090 | A | | 8/2000 | Ausnit | |
| 6,131,374 | A | * | 10/2000 | Bois | 493/214 |
| 6,393,804 | B1 | * | 5/2002 | Ausnit | 493/203 |

* cited by examiner

*Primary Examiner*—Scott A. Smith
*Assistant Examiner*—Paul R Durand
(74) *Attorney, Agent, or Firm*—Pitney Hardin LLP

(57) ABSTRACT

The profiles of a segment of profile zipper are separated and then the profiles at the central portion of the segment are rejoined while the profiles at the ends of the segment are maintained separated. The segment is transported to overlie a bag film web transverse to a moving direction of the web and attached to the web. The web is formed into a reclosable bag with side wall gusset portions of web tucked between the separated profiles.

11 Claims, 2 Drawing Sheets

METHOD OF PREPARING ZIPPER FOR USE IN RECLOSABLE GUSSET BAGS

BACKGROUND OF THE INVENTION

In copending application Ser. No. 09/645,828, filed Aug. 25, 2000 and entitled "GUSSETED ZIPPER BAG" a gusseted reclosable bag is disclosed in which portions of the gusset walls are captured between the zipper profiles. Such gusseted zipper bags have the feature that mating elements of zipper, when they are closed, capture between them portions of the gusset wall which are thinner than the remaining gusset wall thickness. This may be done by thinning these areas or by forming spaced-apart cutouts or windows in the web areas which are subsequently sealed over with segments of film that are thinner than the original film.

During various manufacturing steps in the formation of reclosable bags the zipper needs to be kept closed or the zipper profiles may lose their precise alignment and then not mate properly on re-closing. However, in the formation of the above described type of gusseted reclosable bags the two opposite ends of the zipper profile need to be open and spaced apart during the final manufacturing stage when the thinned out areas of the side gussets of the bag are tucked in between the zipper profiles.

This invention pertains to a method and apparatus for preparing a film web to be used in the a vertical form fill and seal (VFFS) manufacture of such gusseted plastic zipper bags. More particularly, this invention concerns separating the profiles at the ends of a zipper strip and attaching such open-ended zipper transversely across the film web and in the method of making reclosable bags from the web with attached zipper.

SUMMARY OF THE INVENTION

In view of the above a principle object of the present invention is to provide a method and means to open the ends of a segment of zipper early in the manufacturing process of gusseted reclosable bags, when the zipper is initially attached transversely to a bag film web and to maintain the zipper ends continuously open as the film web is formed into a bag on and about the fill tube of form, fill and seal equipment, so that a thinned out area corresponding to the bag gusset can be inserted between the zipper interlocking profiles.

A further object is to provide a method and means to engage the ends of a zipper segment in order to separate the profiles' mating elements at the two opposite ends of the segment for a distance sufficient to receive the gusset sides.

A still further object is to maintain the profile ends of a zipper segment open and separated from each other from the initial opening thereof, while the zipper segment is moved onto a bag film web, while the bag film web with attached zipper is moved into position about the fill tube of an FFS apparatus, and until the thinned areas of the gusset sections of a bag formed from the bag film web material are tucked into the space between the opened zipper elements.

A preferred method to achieve the above objectives is to start with traditional mated zipper profiles, use a separator to separate the mated elements, then close the central part of the zipper segment while leaving each pair of ends open. The zipper may have flanges adjacent one or both sides of the profiles and leading edges of the zipper profile flanges may be tacked or peel sealed together adjacent the locked portion of the zipper segment to prevent side slippage.

The thusly prepared segment of zipper is then moved into position where it transversely overlies the bag film web to which it is sealed. During and after this attachment of the zipper to the bag film web the profiles at the separated ends of the zipper are maintained apart by guides until this portion of bag film web moves down over and around the fill tube and is formed into a reclosable bag.

These and other objects and advantages are attained by providing a method and apparatus for a vertical form fill and seal (VFFS) machine, wherein a segment of zipper having mated profiles has its mating elements, separated and then re-closed only in the central portion of the segment, leaving the profiles at the opposite ends of the segment open and separated. This prepared length of zipper is then positioned to overlie a bag film web transverse to a moving direction of the web with the open ends of the zipper segment adjacent to thinned gusset areas of the bag film web. Guides are provided to maintain the profiles at the ends of the zipper segment separated until the bag film web is moved down over and around a fill tube where it is formed into a reclosable bag.

DETAILED DESCRIPTION OF THE PREFERRED EMBODIMENT

Figure 1:
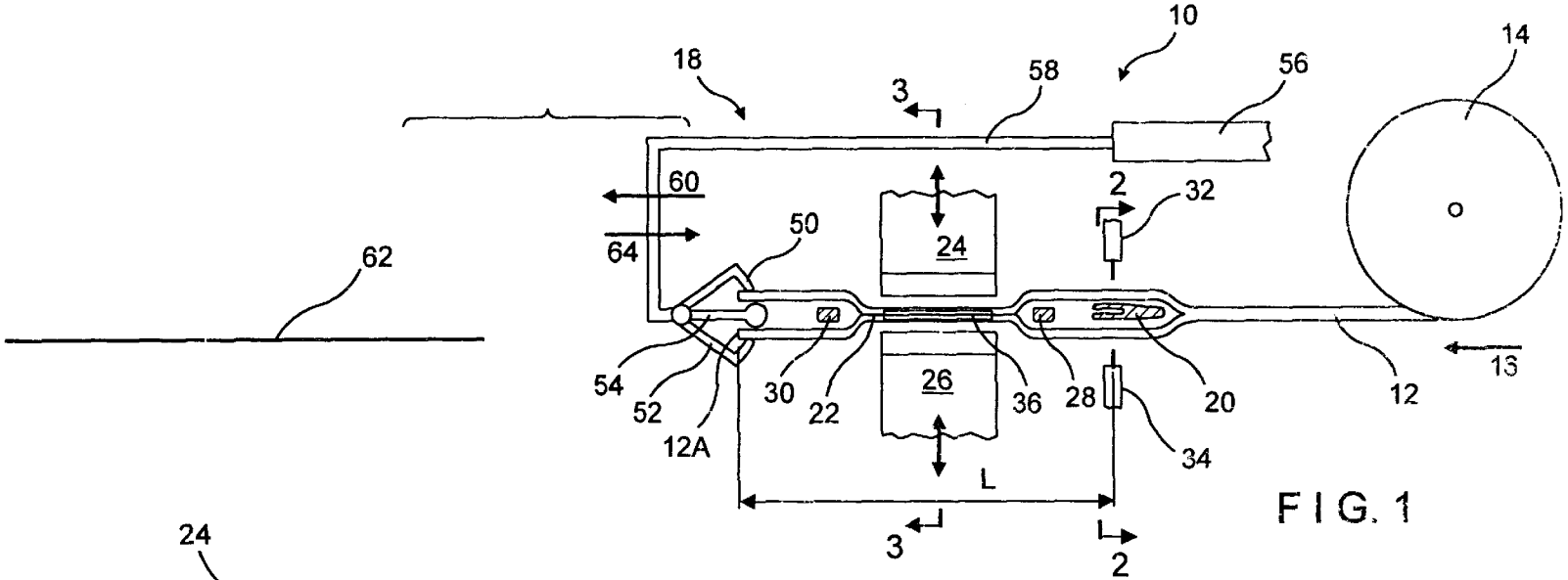
FIG. 1 is a schematic elevation view of a method and apparatus for establishing open ends of a length of zipper.
Figure 2:
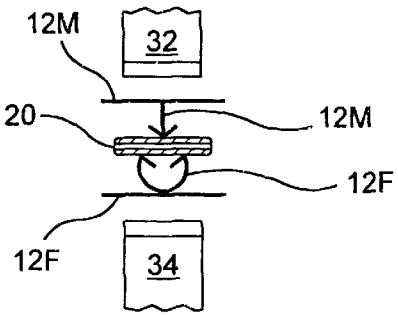
FIG. 2 is a sectional view taken along reference lines 2—2 of FIG. 1.

Reference is now made to the drawings and to FIG. 1 in particular wherein an apparatus 10 is depicted for separating the profiles at the ends of a zipper segment. Accordingly, mated profile zipper 12 spools off drum or source 14 in the direction of arrow 16. A puller 18 pulls the zipper end 12A which was earlier opened by separator 20 whereby the male and female profiles 12M, 12F are separated. It should be appreciated that the profiles may have any of many available mating configurations. After a segment 22 of zipper having a length L is opened by the separator 20, zipper closing plates 24, 26 are activated to converge to rejoin the mating zipper profiles but only in the central area of the segment 22 and leaving the profiles at the two opposite ends of the segment 22 open and separated from each other. To help assure that these ends stay open, retractable fingers 28, 30 are temporarily inserted between the profiles adjacent the sides of the closing plates. Cutting blades 32, 34 are then converged against an anvil portion of separator 20 to separate the segment 22 from the zipper on spool 14.

Figure 3:
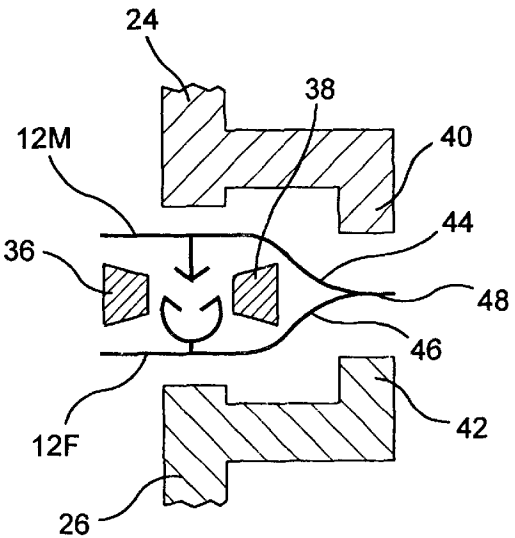
FIG. 3 is a fragmentary sectional view taken along reference lines 3—3 of FIG. 1.

Referring to FIG. 3, it can be seen that the zipper closing bars 24, 26 are positioned to converge and close the male and female interlocking elements of profiles 12M and 12F that were earlier separated by the separator 20. Guide plates 36, 38 are provided to align the interlocking elements to insure proper closing. Closing bars 24, 26 are each provided with offset extensions 40, 42 in the form of seal bars which align with leading flange portions 44, 46 of profiles 12M, 12F. At the same time that bars 24 and 26 converge to close the interlocking elements of profiles 12M, 12F, the seal bars 40, 42 joining the flanges 44, 46 by tacking them together or activating a peel seal 48 between the flanges. Securing the profiles to each other maintains the male and female profiles in proper aligned position relative to each other and prevents separation of the profiles during later form, fill and seal operations.

The cut made by blades 32, 34 establishes the open right-end of the severed zipper segment 22 and the open left end of the next-to-be formed segment of zipper. After the segment 22 is separated from the spool, the fingers 28, 30 are retracted (into the plane of the paper as shown in FIG. 1) and the puller 18 is activated. Puller 18 includes fingers 50, 52 and separator 54. The separator 54 is positioned between the open profiles and the fingers 50, 52 close toward the separator 54 catching each of the separated profiles at the left end of segment 22 between a finger and the separator. After the segment 22 is cut, drive 56 is activated to move arm 58 (and the zipper segment 22) in the direction of arrow 60 to overlie a bag film web 62 transverse to a running direction of the web. After the segment 22 is positioned on web 62, the fingers 50 and 52 are opened (i.e. pivoted away from the separator 54) the arm 58 is moved further in the direction of arrow 60 so as to clear the segment of zipper 22 deposited on the web 62. The arm 58 is then rotated (into or out of the plane of the paper) to clear the segment of zipper after which the arm is returned to its original position and retracted in the direction of arrow 64 to position the fingers 50, 52 to engage the free end of the spool of zipper (where the profiles are already open) and draw the next length L of zipper over separator 20 to repeat the process.

Figure 4:
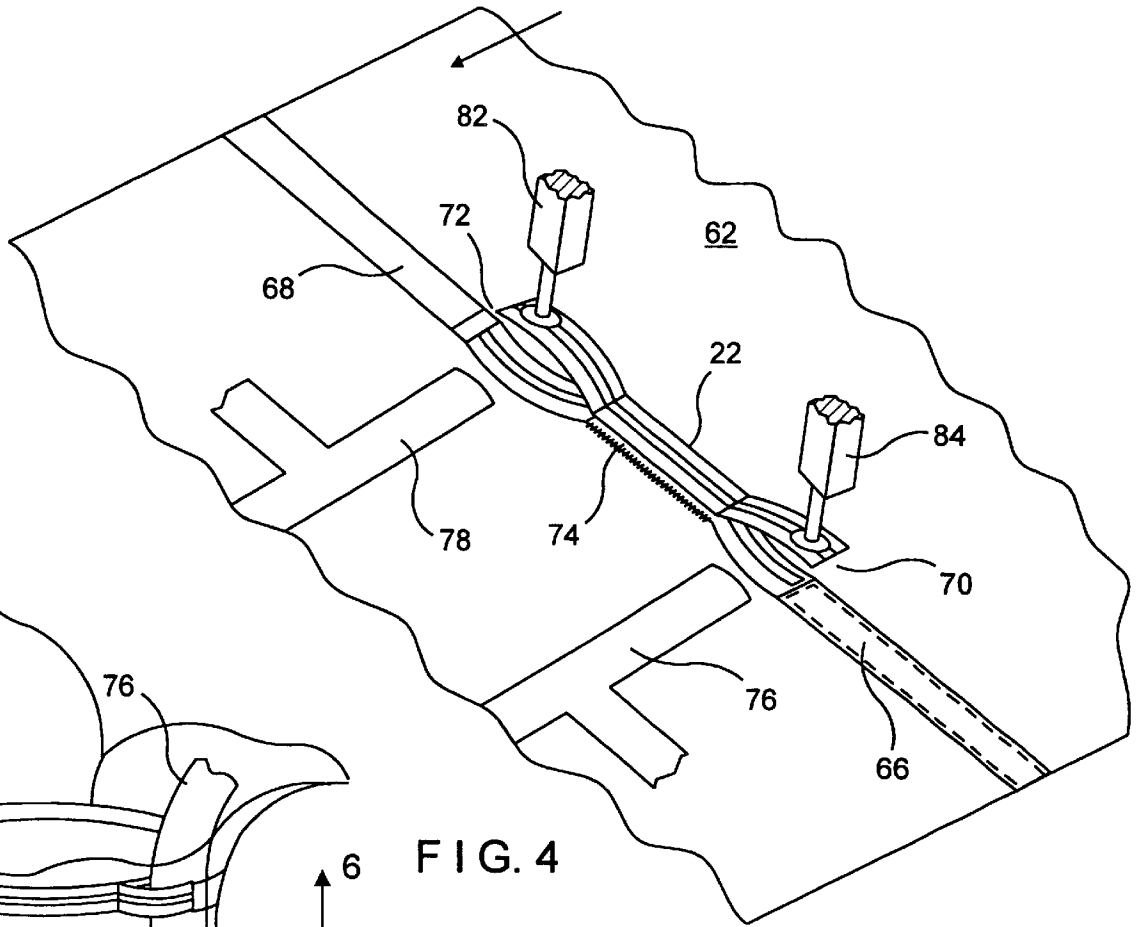
FIG. 4 is a fragmentary perspective view showing a length of zipper with separated profiles at its ends being applied to a bag film web.
Figure 5:
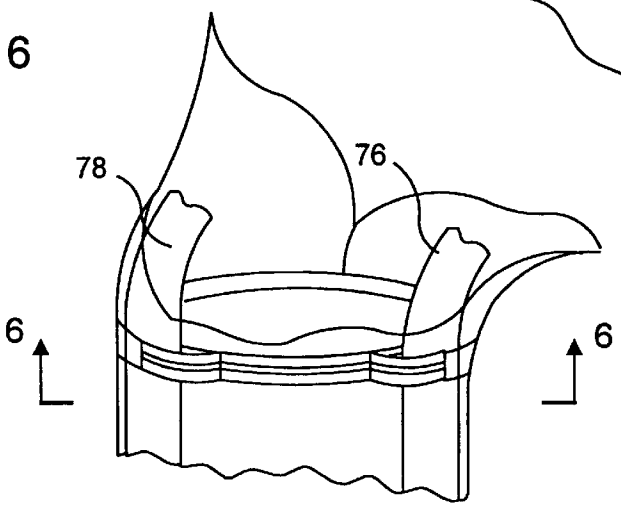
FIG. 5 is a fragmentary perspective view showing the bag film web being guided about a fill tube of a FFS apparatus.

Reference is now made to FIG. 4 wherein the zipper segment 22 is shown positioned on the bag film web 62. As discussed in applicants' copending application, the web 62 is provided with thin film areas 66, 68 in the areas of the web that are to be formed into side gussets and aligned with the zipper profiles. The thin film areas 66, 68 may be formed by providing cutouts in the bag film web that are covered by a relatively thin carrier tape. The length of the cutouts correspond to the expanded length of the side gussets and the height of the cutouts in at least equal to the height of the profiles. Alternatively, the thin film areas can be made my flattening out the film in the required location.

Figure 6:
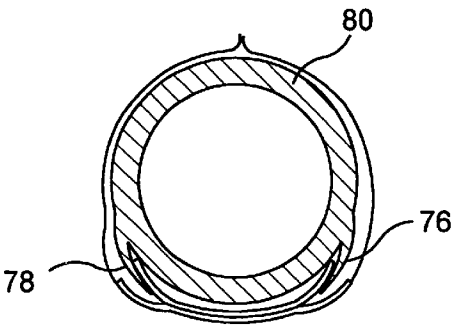
FIG. 6 is a sectional view taken along reference lines 6—6 of FIG. 5.

The zipper segment 22 is positioned transversely across the film with the open ends 70, 72 of the segment adjacent to the thin film areas, 66, 68, respectively. As previously discussed, these thin film areas eventually will become portions of the side gussets folded and tucked into the space between the open profiles interlocking members at the ends of the zipper segment. The segment 22 is then attached to the film 62 by tacking its leading lower flange 74 to the film surface. Guides 76, 78 are positioned between the open profiles at the zipper segment ends. The guides 76, 78 extend to and partially down the fill tube 80 of an associated FFS machine. The guides maintain the profiles at the zipper segment ends open until the gussets are formed and the thinned out areas pushed into the spaces at the respective ends of the zipper profiles as seen in FIG. 6.

To prevent the profiles at the end of the zipper segment 22 from inadvertently interlocking on the bag web 62 upstream of the guides 76, 78 suction devices 82, 84 are provided which may be used to pull the upper profiles of the zipper ends upward and away from the lower profiles to clearly establish the space therebetween and permit the ends of guides 76, 78 to be inserted into the spaces of the separated zipper profile as the bag film web 62 moves toward the bag making equipment.

It should be understood that the fill tube 80 is utilized in a manner well known in the art for forming reclosable plastic bags with zipper transverse to the moving direction of the film web.

Having thus described the invention, what is claimed is:

1. A method of forming a gusseted zipper bag comprising the steps of:

a. providing a length of zipper with mated profile elements;

b. separating said mated profile elements along their length;

c. re-mating a middle area of said length of zipper while maintaining said profile elements at end portions of said length of zipper separated;

d. positioning said length of zipper to overlie a bag film web;

e. attaching said length of zipper to said bag film web;

f. transporting said bag film web with said length of zipper thereon to a bag-forming apparatus while maintaining said profile elements at said end portions separated and g. forming said film into bag with gusset portions of said bag film web folded into spaces between said separated profile elements.

2. A method according to claim 1 comprising the further step of guiding said zipper end portions to maintain said profiles separated from the time the length of zipper is attached to said bag film web to the time said bag film web is formed into a bag with gussets and said gussets are inserted into spaces between said separated profiles at end portions of said length of zipper.

3. A method according to claim 1 comprising the further step of supplying said zipper with mated profiles from and said step of separating said mated profile elements comprises engaging said zipper and pulling said zipper across a separator.

4. A method according to claim 1, wherein said gusset portions of said bag film web folded into spaces between said separated profile elements are thinner than other portions of said bag film web.

5. A method of preparing a length of zipper comprising mating profiles for attachment to a web to form into a side gusseted reclosable bag, said method comprising the steps of:

separating the profiles of said length of zipper; and interlocking elements of each of said profiles to each other at a center portion of said length of zipper while leaving end portions of said length of zipper with separated profiles.

6. The method in accordance with claim 5 wherein said profiles include flanges adjacent to interlocking elements and further comprising the step of joining together said flanges in said center portion.

7. The method of claim 5 comprising the further steps of:

drawing the length of closed zipper from a zipper source about a first separator to separate said mating profiles;

inserting a pair of spaced apart members between said separated profiles to maintain said profiles separated; and rejoining the interlocking elements of said profiles between said spaced apart members.

8. The method of claim 7 comprising the further step of severing said profiles from said zipper source upstream of an upstream one of said members whereby to separate said length of zipper from said zipper source.

9. The method in accordance with claim 8 comprising the further step of drawing said length of zipper onto said web transverse to a moving direction of said web.

10. The method in accordance with claim 9 comprising the further step of maintaining said profiles of said zipper length end portions separated as said web advances toward bag making equipment.

11. The method in accordance with claim 9 wherein the separated end portions of said length of zipper are aligned with thinned out areas of said web.

* * * * *